US007098900B2

(12) United States Patent
Ozawa

(10) Patent No.: US 7,098,900 B2
(45) Date of Patent: Aug. 29, 2006

(54) METHOD OF DRIVING DISPLAY ELEMENTS AND ELECTRONIC APPARATUS USING THE DRIVING METHOD

(75) Inventor: Yutaka Ozawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 382 days.

(21) Appl. No.: 10/083,145

(22) Filed: Feb. 27, 2002

(65) Prior Publication Data

US 2002/0126111 A1 Sep. 12, 2002

(30) Foreign Application Priority Data

Mar. 9, 2001 (JP) ..... 2001-067645
Oct. 25, 2001 (JP) ..... 2001-328328

(51) Int. Cl.
*G09G 5/00* (2006.01)

(52) U.S. Cl. ..... 345/204; 345/212; 345/213; 345/207

(58) Field of Classification Search ..... 345/54, 345/79–80, 89, 204, 206–207, 209, 212–213, 345/611–613, 690–691, 693, 55, 50, 98–99, 345/94, 90, 87
See application file for complete search history.

(56) References Cited

U.S. PATENT DOCUMENTS 4,824,212 A * 4/1989 Taniguchi ..... 345/103
5,805,121 A * 9/1998 Burgan et al. ..... 345/50
5,867,140 A * 2/1999 Rader ..... 345/98
5,926,173 A * 7/1999 Moon ..... 345/211
6,075,510 A * 6/2000 Blouin et al. ..... 345/99
6,236,380 B1 * 5/2001 Wani et al. ..... 345/60
6,771,240 B1 * 8/2004 Inoue et al. ..... 345/87

FOREIGN PATENT DOCUMENTS

JP 0 355 693 A2 * 2/1990
JP 11052942 A * 2/1999

* cited by examiner

*Primary Examiner*—Richard Hjerpe
*Assistant Examiner*—Leonid Shapiro
(74) *Attorney, Agent, or Firm*—Oliff & Berridge, PLC

(57) ABSTRACT

Due to a characteristic of a switching element, a current leaks into a display element in an undisplayed region through the switching element to thereby cause a speckled pattern to occur in the undisplayed region. In addition to a supply of scanning signals to scanning lines corresponding to display elements in a displayed region, scanning signals are also supplied to scanning lines corresponding to display elements in the undisplayed region to thereby inhibit the speckled pattern from occurring.

13 Claims, 6 Drawing Sheets

METHOD OF DRIVING DISPLAY ELEMENTS AND ELECTRONIC APPARATUS USING THE DRIVING METHOD

BACKGROUND OF THE INVENTION

1. Field of Invention

The present invention relates to a method of driving display elements, such as liquid crystal devices, and an electronic apparatus for which the method of driving the display elements is used.

2. Description of Related Art

In a related art method of driving a plurality of display elements, the plurality of display elements arranged in a matrix and constituting a region for displaying characters and images, are driven by using a plurality of switching elements, such as TFTs (Thin Film Transistors) connected to the plurality of display elements. In more detail, a so-called line sequential driving is performed, in which simultaneous activation of a specified number of the switching elements, arranged in a direction of a row (X-direction), i.e., in a direction of a scanning line, is sequentially performed in a direction of columns (Y-direction), i.e., in a direction of data lines. This is performed by sequentially supplying scanning signals, for sequentially activating the plurality of switching elements, that is, for driving the plurality of display elements, to the plurality of scanning lines for controlling activation of the plurality of switching elements.

As described above, each of the scanning lines is used for activating each of the specified number of switching elements, i.e., for driving the specified number of the display elements. Therefore, when the characters and images are only to be displayed in a certain part of the region, by only supplying the scanning signals to scanning lines corresponding to the display elements in the certain part of the region out of the plurality of scanning lines, the characters and images can be displayed in the certain part of the region. That is, the characters and images can be displayed in the certain part of the region without supplying the scanning signals to the scanning lines corresponding to display elements in the other part of the region, excluding the certain part of the region, where none of the characters and images are allowed to be displayed.

However, a problem exists in which, due to a characteristic of the switching element, when off-resistance is not sufficiently large, for example, a current is leaked to a display element in the other part of the region through the switching element to thereby cause a speckled pattern in the other part of the region.

SUMMARY OF THE INVENTION

In order to address the above-described problem, in accordance with the present invention, a method of driving a plurality of display elements arranged in a matrix and constituting a region to make each display element display in the region, a gray level that the display element should display through at least one frame period of a plurality of frame periods, by using a plurality of scanning lines for supplying a scanning signal that selects the display element and a plurality of data lines for supplying a data signal that specifies the gray level, the method comprises a first supplying step of supplying the scanning signal to certain scanning lines of the plurality of scanning lines, the certain scanning lines corresponding to display elements included in a certain part of the region for displaying the gray level; and a second supplying step of supplying the scanning signal to both the certain scanning lines and scanning lines other than the certain scanning lines of the plurality of scanning lines, the other scanning lines corresponding to display elements included in the other part of the region for not displaying the gray level other than the certain part of the region.

Furthermore, an electronic apparatus according to the present invention is provided in which, to display a gray level to be displayed through at least one frame period of a plurality of frame periods specified by image data, a plurality of scanning lines that supply scanning signals to a region including a plurality of display elements arranged in a matrix and a plurality of data lines that supply data signals to the region are used to drive the plurality of display elements, thereby displaying the gray level. The scanning signals select the plurality of display elements, and the data signals specify gray levels to be displayed by the plurality of display elements. The apparatus includes an input circuit that inputs information to specify the image data, a production circuit that produces the image data according to the information inputted from the input circuit, and a display circuit that displays the image data produced by the production circuit. The display circuit supplies the scanning signals to the certain scanning lines of the plurality of scanning lines, the certain scanning lines corresponding to display elements included in a certain part of the region for displaying the gray level, and supplies the scanning signals to both of the certain scanning lines and the other scanning lines of the plurality of scanning lines, excluding the certain scanning lines, the other scanning lines corresponding to display elements included in the other part of the region, excluding the certain part of the region, to make the gray level undisplayed.

DETAILED DESCRIPTION OF PREFERRED EMBODIMENTS

A specific example of the method of driving display elements according to the invention is described below.

SPECIFIC EXAMPLE 1

Figure 1:
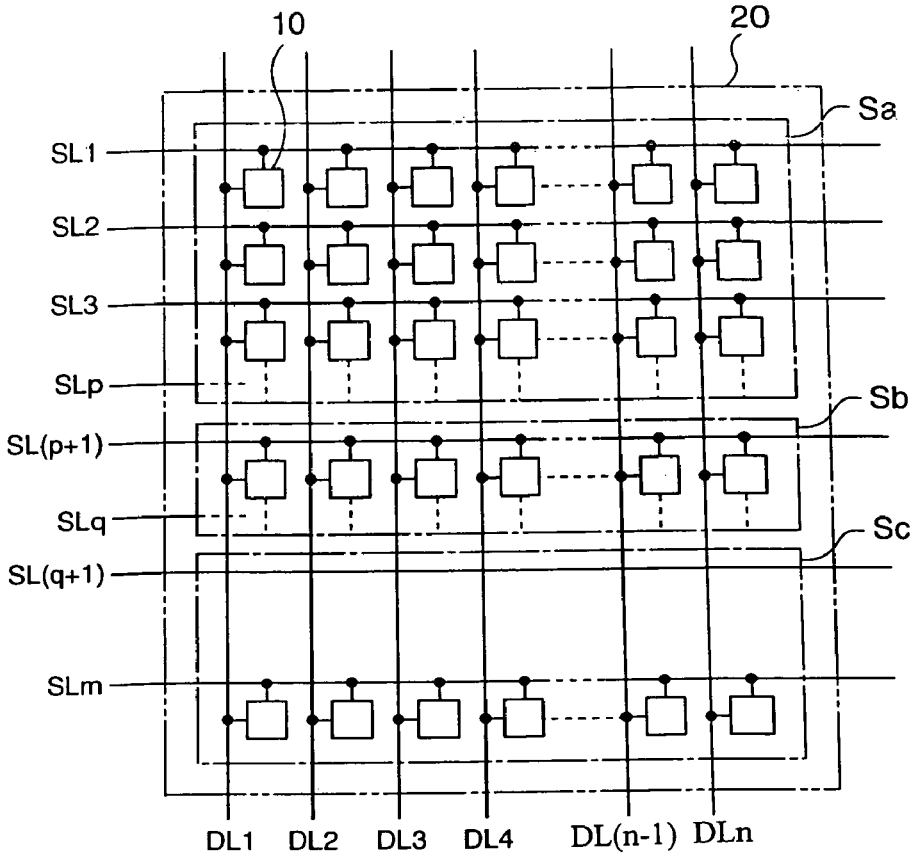
FIG. 1 is a schematic of a display element to be driven by a driving method in a specific example 1.

FIG. 1 shows display elements to be driven by the driving method according to a specific example 1. A plurality of display elements 10 are arranged in a matrix with m rows and n columns as shown in FIG. 1 so as to form a region 20 to display characters and images, for example. Driving of the plurality of display elements 10 is controlled by using m number of scanning lines SL1 to SLm and n number of data lines DL1 to DLn. The scanning lines SL1 to SLm are used to supply scanning signals to drive the plurality of display elements 10 through switching elements such as TFTs, namely, to select the plurality of display elements 10. The data lines DL1 to DLn are used to supply data signals to specify gray levels such as two gray levels and multi-gray levels to be displayed by each of the plurality of display elements 10 through at least one frame period.

The above-described display elements 10 are driven by the driving method in the specific example 1 including a traditionally known line sequential driving method or a traditionally known subfield driving method. According to the above-described line sequential driving method, as described above, simultaneous activation of a specified number of switching elements aligned in the direction of the scanning lines is performed in the direction of the data lines in order.

On the other hand, according to the subfield driving method, in one frame period, simultaneous selection of a specified number of the display elements 10 aligned in the row direction (X direction) (for example, n number of display elements aligned on the scanning line SL1) performed out in the column direction (Y direction) in order. Namely, there are performed a line sequential supply of the scanning signals to the scanning lines SL1, SL2, SL3, . . . , SL(m−1), SLm, SL1, SL2, . . . in this order, and a supply of data signals for the specified number of the display elements to the specified number of the display elements 10, respectively, through the data lines DL1 to DLn. In addition, the line sequential supply of the scanning signals is circulated to the scanning lines SL1 to SLm once in each subfield period of a plurality of subfield periods constituting the one frame period. In this way, the data signals supplied to the data lines are provided to the display elements 10 selected by the scanning signals supplied to the scanning lines to thereby drive the above-described display elements 10. The display elements 10 hold charge supplied by the data signals until the display elements 10 are driven in the same way in the next time.

The operation, in other words, performs once without fail, in each subfield period, driving of the specified number of the display elements 10 arranged on the scanning line SL1, driving of the specified number of the display elements 10 arranged on the scanning line SL2, . . . , and driving of the specified number of the display elements 10 arranged on the scanning line SLm. A pulse width modulation is performed with a pulse width made equal to the length of a period for the display element 10 to hold the charge supplied by the data signal within one frame period. The length of the period is determined based on which subfield period of the plurality of subfield periods is provided for the data signal to be supplied to the display element 10. This provides differences in effective voltage values to be supplied to the display element 10 to allow the display elements 10 to display the gray levels, more exactly, multi-gray levels.

In the following explanation, in order to facilitate the explanation and understanding thereof, the region 20 is assumed to be divided beforehand into a region Sa where the gray level is not displayed (hereinafter referred to as "undisplayed region Sa"), a region Sb where the gray level is displayed (hereinafter referred to as "displayed region Sb"), and a region Sc where the gray level is not displayed (hereinafter referred to as "undisplayed region Sc"). It is assumed that the scanning lines SL1 to SLp correspond to the undisplayed region Sa, the scanning lines SL(p+1) to SLq correspond to the displayed region Sb, and the scanning lines SL(q+1) to SLm correspond to the undisplayed region Sc.

Figure 2:
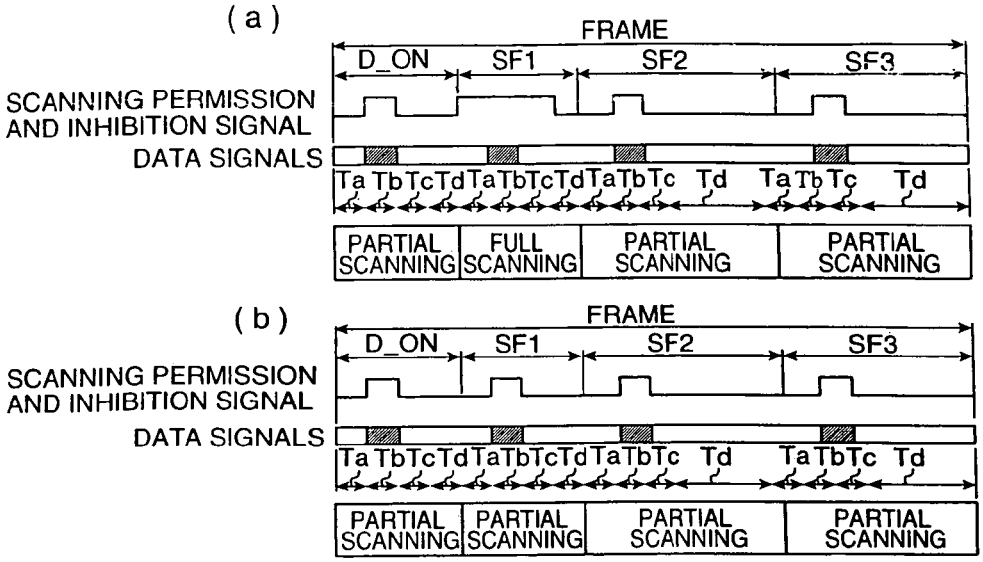
FIGS. 2(*a*) and 2(*b*) are time charts of a driving method based on a subfield period.
Figure 3:
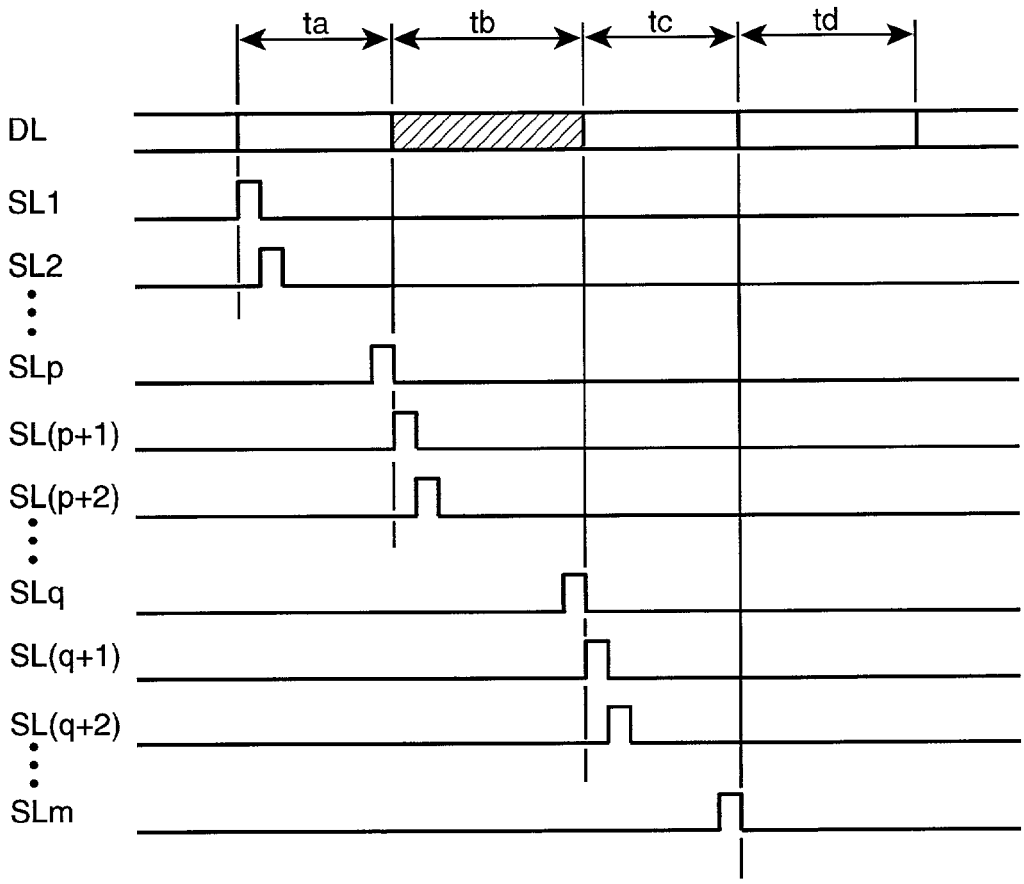
FIG. 3 is a time chart of an operation of a full scanning.
Figure 4:
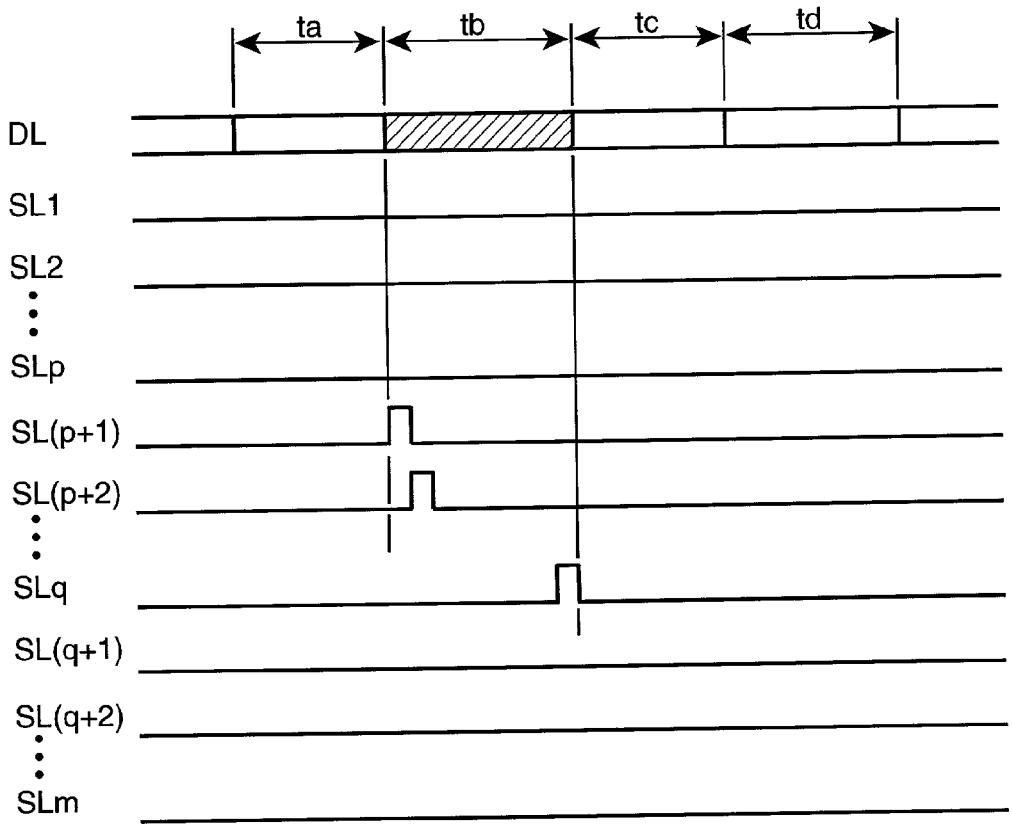
FIG. 4 is a time chart of an operation of a partial scanning.

FIGS. 2(*a*) and 2(*b*) are time charts of a driving method of the specific example 1 based on the subfield period, FIG. 3 is a time chart showing an operation of a full scanning shown in FIGS. 2(*a*) and 2(*b*), and FIG. 4 is a time chart showing an operation of a partial scanning shown in FIGS. 2(*a*) and 2(*b*). One frame period, as shown in FIG. 2(*a*), includes an ON period D_ON, and subfield periods SF1 to SF3. In the ON period D_ON, data signals determined by voltage transmittance characteristics of the display elements 10, data signals that drive the display elements 10, for example, are supplied to the data lines DL1 to DLm to thereby drive the display elements 10. On the other hand, in the subfield periods SF1 to SF3, in accordance with the gray level data, the data signals for the display elements 10 are supplied to the data lines DL1 to DLm. In order to make each of the display elements 10 display multi-gray levels, such as the eight gray levels, the subfield periods SF1 to SF3 are provided with lengths that are different from one another. Specifically, the length of the subfield period SF2 is approximately twice that of the subfield period SF1, and the length of the subfield period SF3 is set to be approximately twice that of the subfield period SF2.

Each of the ON period D_ON and the subfield periods SF1 to SF3 includes periods Ta, Tb, Tc and Td. The period Ta is used to select the display elements 10 arranged on each of the scanning lines SL1 to SLp corresponding to the undisplayed region Sa by using the scanning line. The period Tb is used to select the display elements 10 arranged on each of the scanning lines SL(p+1) to SLq corresponding to the displayed region Sb by using the scanning line. The period Tc is used to select the display elements 10 arranged on each of the scanning lines SL(q+1) to SLm corresponding to the undisplayed region Sc by using the scanning line. The period Td is used for selecting none of the display elements 10 arranged on the scanning lines SL1 to SLm, thereby adjusting the length of each of the subfield periods for pulse width modulation.

In FIG. 2(*a*), a scanning permission and inhibition signal specifies permission or inhibition of supplying the scanning signals to the scanning lines SL1 to SLm. In more detail, the scanning permission and inhibition signal in a high level shows that the scanning signals are permitted to be supplied to the scanning lines, and the scanning permission and inhibition signal in a low level shows that the above scanning signals are inhibited from being supplied to the scanning lines.

Also in FIG. 2(*a*), a hatched part 32 of the data signals 30 shows that data signals according to the gray level data are supplied to the data lines DL1, . . . , DLn. An unhatched part 34 of the data signals 30 shows that data signals, with voltages less than a voltage necessary to drive the display elements 10, that is, voltages that can not drive the display elements 10 (hereinafter referred to as "undriving voltages") are supplied to the data lines. The undriving voltages, in more detail, for example, are voltages to make the display elements 10 display white in a normally white mode. In a normally black mode, the undriving voltages correspond to voltages for making the display elements 10 display black.

In the ON period D_ON, with the scanning permission and inhibition signal being in a high level only in the period Tb, the display elements are operated as follows. In the period Ta for the undisplayed region Sa of the ON period D_ON, none of the scanning signals is supplied to the scanning lines SL1 to SLp corresponding to the undisplayed region Sa. Moreover, to the data lines DL1 to DLn, the data signals of undriving voltages are supplied. The display elements 10 in the undisplayed region Sa are not selected because none of the scanning signals is supplied to the scanning lines SL1 to SLp. This makes the display elements 10 in the undisplayed region Sa undriven, so that the undisplayed region Sa is made undisplayed.

In the period Ta of the ON period D_ON, no scanning signals are supplied to the scanning lines SL1 to SLp corresponding to the undisplayed region Sa, that is, no display elements 10 in the undisplayed region Sa are selected. This makes it possible to use data signals with voltages other than the undriving voltages instead of the data signals with the above-described undriving voltages. This is because, even with such data signals, none of the charges by the data signals is supplied to the display elements 10 in the undisplayed region Sa to thereby make the undisplayed region Sa undisplayed.

In the period Tb of the ON period D_ON for the displayed region Sb, scanning signals are supplied to the scanning lines SL(p+1) to SLq corresponding to the displayed region Sb. Moreover, to the data lines DL1 to DLn, supplied data signals with voltages determined by voltage transmittance characteristics of the display elements 10 as described above are supplied. Accordingly, since the displayed region Sb is selected by the scanning signals supplied to the scanning lines SL(p+1) to SLq, the display elements 10 in the displayed region Sb are driven by the data signals, that is, the displayed region Sb is displayed in response to the data signals.

In the period Tc of the ON period D_ON for the undisplayed region Sc, no scanning signals are supplied to the scanning lines SL(q+1) to SLm corresponding to the undisplayed region Sc. Moreover, to the data lines DL1 to DLn, data signals with the undriving voltages are supplied. As none of the scanning signals is supplied to the scanning lines SL(q+1) to SLm, no display elements 10 in the undisplayed region Sc are selected. Therefore, the undisplayed region Sc is made undisplayed.

In the period Td of the ON period D_ON, no scanning signals are supplied to any of the scanning lines SL1 to SLm. Moreover, the data signals with the undriving voltages are supplied to any of the data lines DL1 to DLn.

In the subfield period SF1 as a period of full scanning subsequent to the ON period D_ON, the scanning permission and inhibition signal is in a high level during the periods Ta through Tc so as to operate as follows. In the period Ta of the subfield period SF1 for the undisplayed region Sa, as shown in FIG. 3, scanning signals are supplied to the scanning lines SL1 to SLp corresponding to the undisplayed region Sa. Moreover, to the data lines DL1 to DLn, data signals of the undriving voltage are supplied. This makes the display elements 10 in the undisplayed region Sa selected by the scanning signals through the scanning lines SL1 to SLp, and supplied with charges by the data signals with the undriving voltages through the data lines DL1 to DLn. However, since the voltages of the data signals are the undriving voltages, the display elements 10 in the undisplayed region Sa are undriven. As a result, the undisplayed region Sa is not displayed.

In the period Tb of the subfield period SF1 for the displayed region Sb, as shown in FIG. 3, scanning signals are supplied to the scanning lines SL(p+1) to SLq corresponding to the displayed region Sb. Moreover, to the data lines DL1 to DLn, there are supplied data signals determined by the gray level data. The supply of the scanning signals to the scanning lines SL(p+1) to SLq allows the display elements 10 in the displayed region Sb to be selected. In addition, the display elements 10 are charged with electric charges by the data signals. This makes the display elements 10 in the displayed region Sb driven to make the displayed region Sb displayed in response to the data signals.

In the period Tc of the subfield period SF1 for the undisplayed region Sc, as shown in FIG. 3, scanning signals are supplied to the scanning lines SL(q+1) to SLm corresponding to the undisplayed region Sc. Moreover, to the data lines DL1 to DLn, data signals of the undriving voltage are supplied. This makes the display elements 10 in the undisplayed region Sc undriven, as with the display elements 10 in the above-described undisplayed region Sa, to make the undisplayed region Sc undisplayed.

In the subfield period SF2 as a period of partial scanning subsequent to the subfield period SF1, the scanning permission and inhibition signal is in a high level only during the period Tb. Thus, as shown in FIG. 4, none of the scanning signals is supplied to the scanning lines SL1 to SLp corresponding to the undisplayed region Sa and to the scanning lines SL(q+1) to SLm corresponding to the above-described undisplayed region Sc. This makes the undisplayed region Sa and the undisplayed region Sc undisplayed. On the other hand, as shown in FIG. 4, the scanning signals are supplied to the scanning lines SL(p+1) to SLq corresponding to the displayed region Sb. Moreover, to the data lines DL1 to DLn, data signals determined by the above-described gray level data are supplied. Thus, the displayed region Sb is displayed.

In addition, in the subfield period SF3 as a period of partial scanning subsequent to the subfield period SF2, like in the subfield period SF2 as the period of partial scanning, the scanning permission and inhibition signal is in a high level only during the period Tb. Thus, like in the subfield period SF2, the undisplayed region Sa and the undisplayed region Sc are not displayed, whereas the display region Sb is displayed.

As described above, in the method of driving the display element in the specific example 1, within one frame period, in the subfield period SF1 of the ON period D_ON, and three subfield periods SF1 to SF3 included in the frame period, scanning signals are supplied to the scanning lines SL1 to SLp corresponding to the undisplayed region Sa, the scanning lines SL(p+1) to SLq corresponding to the displayed region Sb, and the scanning lines SL(q+1) to SLm corresponding to the undisplayed region Sc, i.e. the scanning signals are supplied to all of the scanning lines SL1 through SLm to thereby select all of the display elements 10 constituting the region 20. Thus, the undisplayed regions Sa and Sc, which are not supposed to be selected, are once selected in one frame period. This makes it possible to inhibit the speckled pattern from occurring in the region 20. In other words, by making a period to select all of the display elements 10 longer than a period to select only some of display elements 10 without selecting all of the display elements 10, the speckled pattern can be inhibited from occurring. In addition, the method of driving all of the display elements 10 with the period to select the display elements 10 made longer can reduce electric power consumed in the display elements 10 compared with the driving method without making the period longer.

It is also possible that, instead of the subfield period SF1, in the subfield period SF2 or the subfield period SF3, for example, the scanning signals are supplied to all of the scanning lines SL1 to SLm to select all of the display elements 10 to thereby inhibit the speckled pattern from occurring in the region 20.

To select all of the display elements 10 once in the above-described one frame period, and to never select any of the display elements 10 in the one frame period as shown in FIG. 2(*b*) are combined. With this, namely, in one frame period, the full scanning is performed once according to FIG. 2(*a*), and at least in one of other frame periods subsequent to the one frame period, no full scanning is performed according to FIG. 2(*b*). This makes it possible to inhibit the above-described speckled pattern from occurring on the region 20. In addition, with such combination of the selection shown in FIG. 2(*a*) and the selection shown in FIG. 2(*b*), it becomes possible to reduce electric power consumed in the display elements 10 compared with only performing the selection shown in FIG. 2(*a*). Such a driving method is effective when there is no necessity for the switching element to perform the full scanning once in one frame period without fail according to FIG. 2(*a*).

Figure 5:
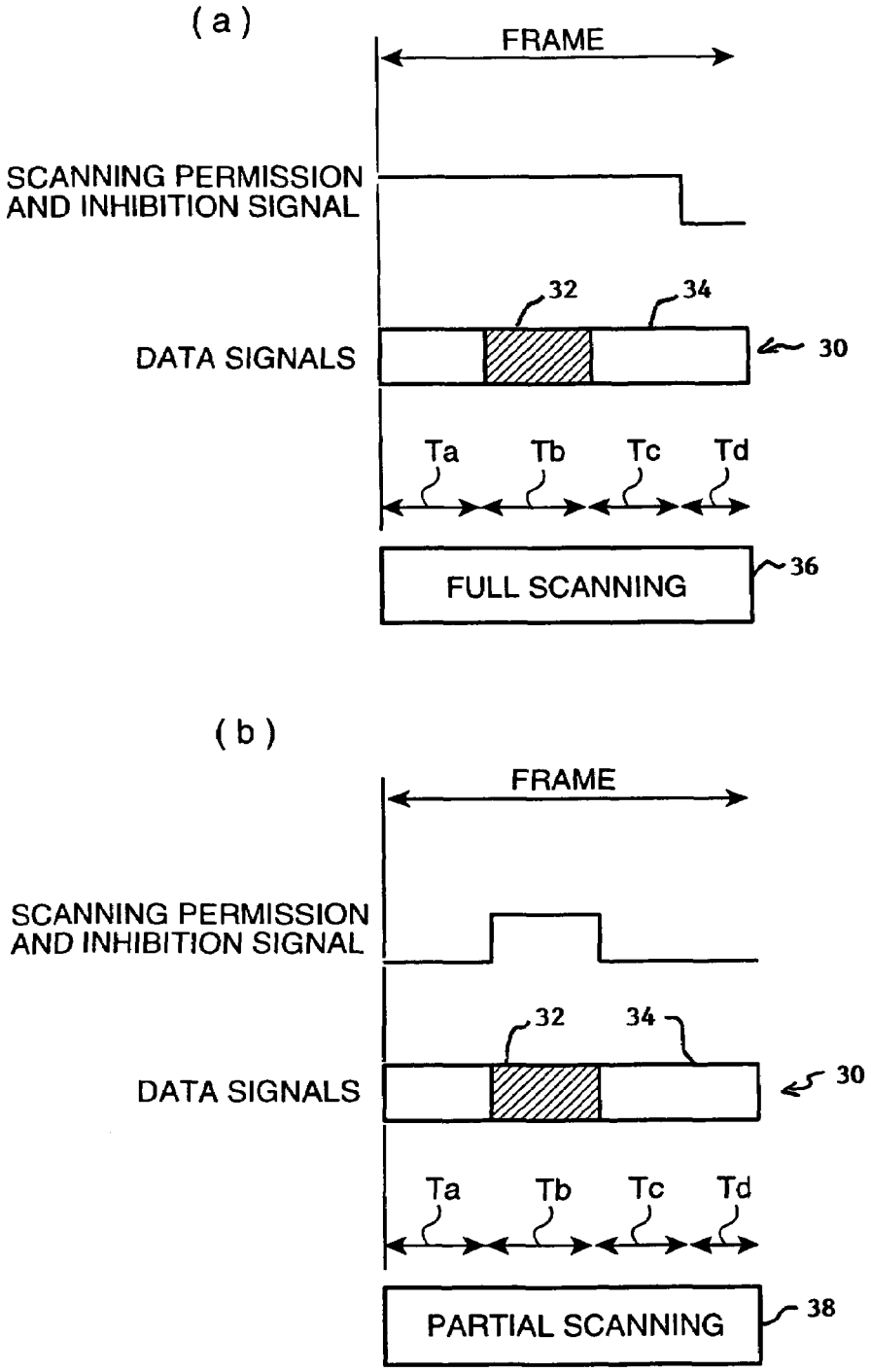
FIGS. 5(*a*) and 5(*b*) are time charts of a driving method based on frame period.

FIGS. 5(*a*) and 5(*b*) are time charts of a driving method based on frame period. Instead of determining in every subfield period whether the undisplayed regions Sa and Sc are selected or not, the driving method combines frame periods. A full scanning frame period 36, as shown in FIG. 5(*a*), in which all of the display elements 10 are selected. A partial scanning frame period 38, as shown in FIG. 5(*b*), in which only display elements 10 in the displayed region Sb, not all of the display elements 10 in the region 20, are selected. The driving method combines these frame periods. As with the above-described example, this makes it possible to inhibit the speckled pattern from occurring in the region 20.

SPECIFIC EXAMPLE 2

Figure 6:
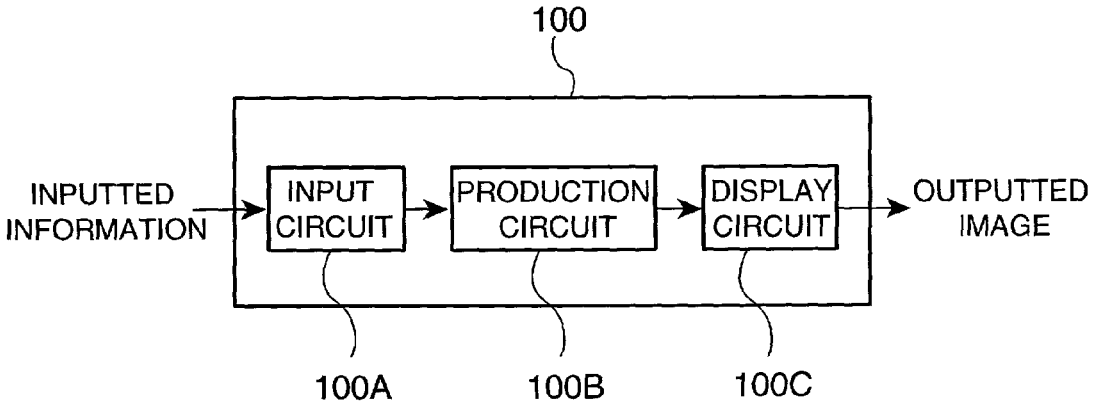
FIG. 6 is a schematic of a configuration of an electronic apparatus in a specific example 2.

FIG. 6 shows a configuration of an electronic apparatus in a specific example 2. The electronic apparatus 100, as shown in FIG. 6, includes an input circuit 100A which includes, for example, a key board or a switch to input information such, as an instruction or data, a production circuit 100B which itself produces image data according to information inputted from the input circuit 100A, reads out from a storage circuit (unillustrated) image data stored beforehand, or receives image data from an external apparatus (unillustrated), and a display circuit 100C as a display unit which displays the above-described image data produced by the production circuit 100B. The electronic apparatus 100, that is provided with the above-described configuration, can display an image specified by the inputted information, an image relating to the electronic apparatus 100, an externally provided image, and the like. Examples of typical electronic apparatuses according to the specific example 2, include a projector, a mobile computer, and a cellular phone, for example.

ADVANTAGE OF THE INVENTION

As described above, according to the method of driving display elements in the present invention, in addition to a supply of the scanning signals to the certain scanning lines corresponding to display elements in the certain part of the region to display the gray level, scanning signals are also supplied to the other scanning lines corresponding to display elements in the other part of the region for making the gray level undisplayed. This can inhibit occurrence of the speckled pattern caused by current leakage due to characteristics of the switching elements.

What is claimed is:

1. A method of driving a plurality of display elements, which are arranged in a matrix and which constitute a region to make each display element display in the region a gray level that the display element should display through at least one frame period of a plurality of frame periods, by using a plurality of scanning lines for supplying a scanning signal that selects the display and a plurality of data lines for supplying a data signal that specifies the gray level, the method comprising:

a partial display mode including:

a first supplying step of supplying the scanning signal to certain scanning lines of the plurality of scanning lines and not to other scanning lines of the plurality of scanning lines, the certain scanning lines corresponding to display elements included in a certain part of the region for displaying the gray level, the other scanning lines corresponding to display elements included in another part of the region other than the certain part of the region, the first step including supplying a data signal that specifies the gray level to the plurality of data lines corresponding to the display elements included in the certain part of the region; and a second supplying step of supplying the scanning signal to both the certain scanning lines and the other scanning lines, the second step including:

supplying a data signal that specifies the gray level to the plurality of data lines corresponding to the display elements included in the certain part of the region, and supplying a non-display signal that specifies a non-display voltage level to the plurality of data lines corresponding to the display elements included in the other part of the region.

2. The method according to claim 1, wherein one of the first and second supplying steps is performed in each of the frame periods.

3. The method according to claim 1, wherein the first and second supplying steps are performed at least once in each of the frame periods.

4. The method according to claim 3, wherein each of the frame periods has a plurality of subfield periods each used for performance of one of the first and second supplying steps.

5. The method according to claim 4, wherein the second supplying step is performed in one subfield of the plurality of subfields, and the first supplying step is performed in a subfield other than the one subfield thereof.

6. The method according to claim 4, wherein the second supplying step is performed in one subfield of subfields included in the plurality of frame periods, and the first supplying step is performed in a subfield other than the one subfield thereof.

7. The method according to claim 1, wherein the first and second supplying steps are performed periodically.

8. The method according to claim 7, wherein a period of the second supplying step is longer than a period of the first supplying step.

9. The method according to claim 1, wherein the second supplying step includes a step of applying the data signal making the display element undriven to the data line corresponding thereto when supplying the scanning signals to the other scanning lines.

10. The method according to claim 1, wherein during the first supplying step, a scanning inhibition signal that prohibits supply of the scanning signal is supplied to the other scanning lines.

11. An electronic apparatus in which, to display a gray level to be displayed through at least one frame period of a plurality of frame periods specified by image data, a plurality of scanning lines that supply scanning signals to a region comprising a plurality of display elements arranged in a matrix and a plurality of data lines that supply data signals to the region are used to drive the plurality of display elements, thereby displaying the gray level, the scanning signals selecting the plurality of display elements, and the data signals specifying gray levels to be displayed by the plurality of display elements, the electronic apparatus comprising:

an input circuit that inputs information to specify the image data;

a production circuit that produces the image data according to the information inputted from the input circuit; and a display circuit that displays the image data produced by the production circuit, the display circuit supplying:

the scanning signals to certain scanning lines of the plurality of scanning lines and not to other scanning lines of the plurality of scanning lines and a data signal, the certain scanning lines corresponding to display elements included in a certain part of the region for displaying the gray level, the other scanning lines corresponding to display elements included in another part of the region other than the certain part of the region, the data signal specifying the gray level to the plurality of data lines corresponding to the display elements included in the certain part of the region, and the scanning signals to both the certain scanning lines and the other scanning lines, to make the gray level undisplayed and the data signal that specifies the gray level to the plurality of data lines corresponding to the display elements included in the certain part of the region and including supplying a non-display signal that specifies a non-display voltage level to the plurality of data lines corresponding to the display elements included in the other than the certain part of the region.

12. The method according to claim 1, wherein the non-display signal is an undriven voltage so that the display elements display white in a normally white mode or black in a normally black mode.

13. The apparatus according to claim 11, wherein the non-display signal is an undriven voltage so that the display elements display white in a normally white mode or black in a normally black mode.

* * * * *